US006237187B1

(12) United States Patent
Hult et al.

(10) Patent No.: US 6,237,187 B1
(45) Date of Patent: May 29, 2001

(54) WET/DRY VACUUM DOLLY

(75) Inventors: David R. Hult; Jeffrey L. Young, both of St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/369,111

(22) Filed: Aug. 5, 1999

Related U.S. Application Data

(60) Provisional application No. 60/098,578, filed on Aug. 31, 1998.

(51) Int. Cl.[7] ..... A47L 9/00

(52) U.S. Cl. ..... 15/323; 15/327.2; 15/353

(58) Field of Search ..... 15/323, 327.1, 15/327.2, 327.6, 327.7, 353; D32/21–24

(56) References Cited

U.S. PATENT DOCUMENTS

D. 159,960 * 9/1950 Davey ..... 15/323
2,917,769 * 12/1959 Kasper ..... 15/323
4,799,699 * 1/1989 Berfield et al. ..... 15/323
5,313,686 * 5/1994 Berfield ..... 15/323
5,515,573 * 5/1996 Frey ..... 15/323
5,528,794 * 6/1996 Tomasiak ..... 15/323

* cited by examiner

*Primary Examiner*—Terrence R. Till
(74) *Attorney, Agent, or Firm*—Howrey, Simon, Arnold and White, LLP

(57) ABSTRACT

A wet/dry vac comprises a generally U-shaped dolly having wheels mounted thereon; a collection drum; a dolly; a lid coupled to the collection drum; a powerhead assembly coupled to the lid; an inlet port disposed in one of the lid or the collection drum; and a receptacle coupled to the input port. The dolly includes a collection drum, the dolly comprises a generally U-shaped member, which is adapted to have wheels mounted thereon, and at least two mounting members situated on either side of the open end of the U-shaped member. Each mounting member is adapted to mate with a corresponding mounting cavity defined by the collection drum. The dolly further includes a locking member adapted to snap into a locking cavity defined by the collection drum. The dolly further includes at least two extending members. Each extending member is adapted to mate with a recess defined by the collection drum.

34 Claims, 11 Drawing Sheets

FIG. 1
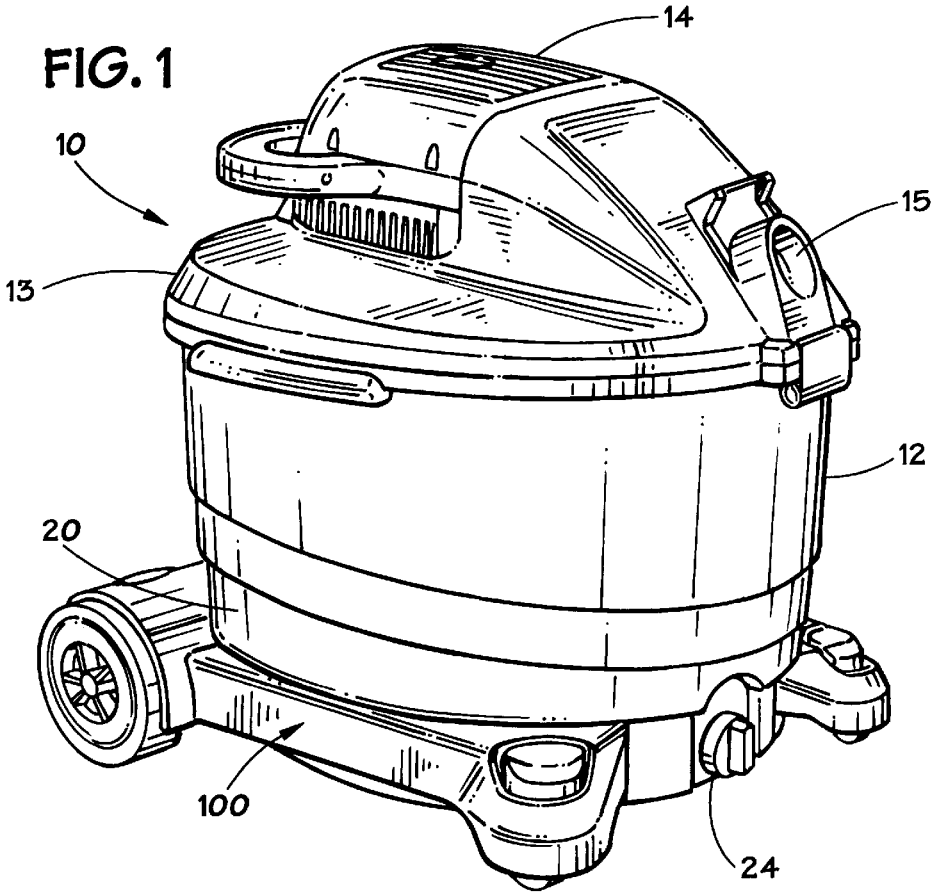
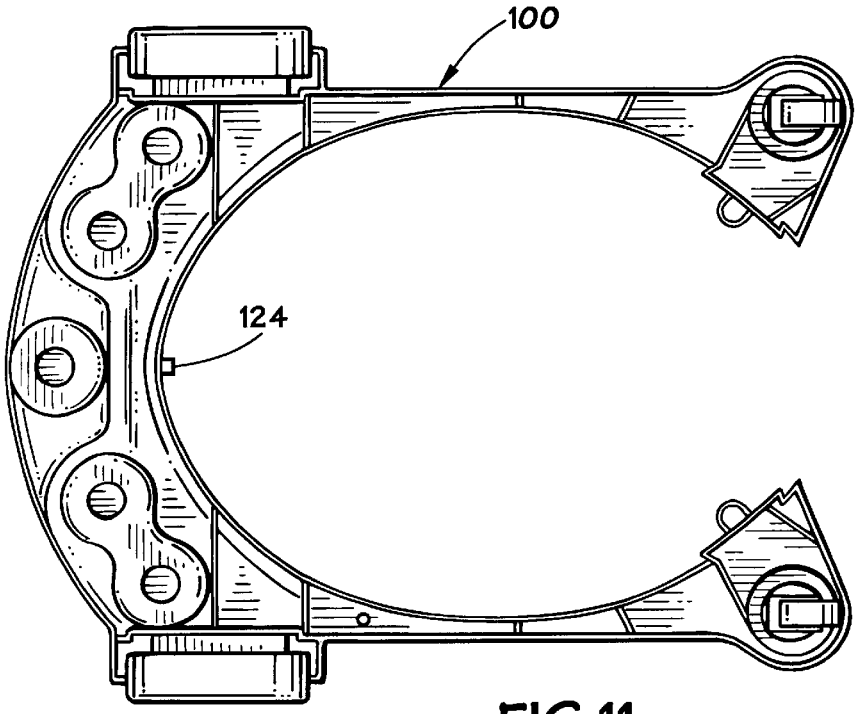
FIG.11

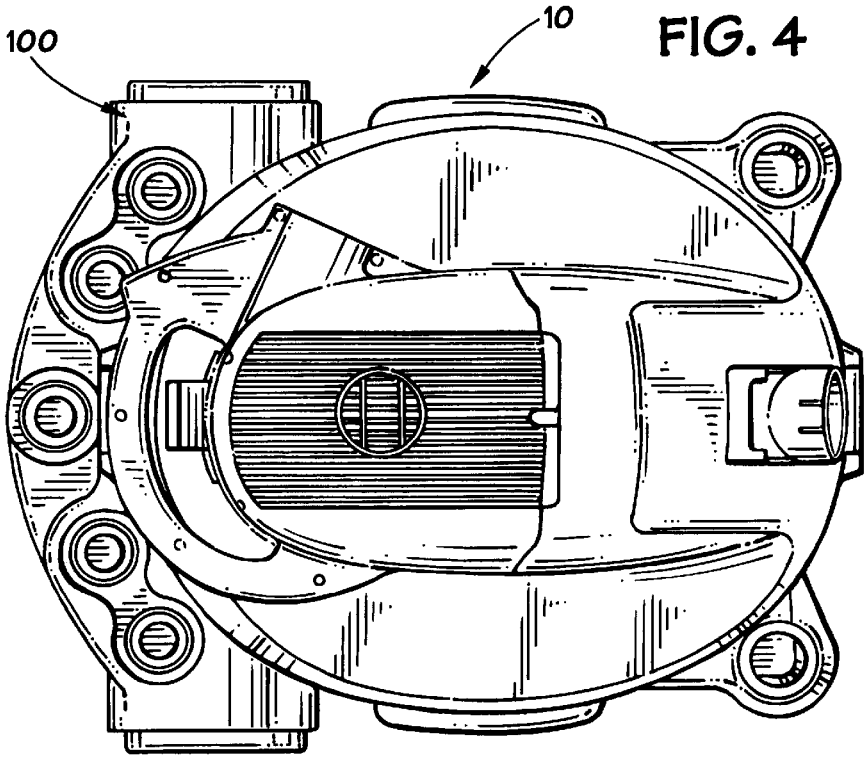
FIG. 4
FIG. 5
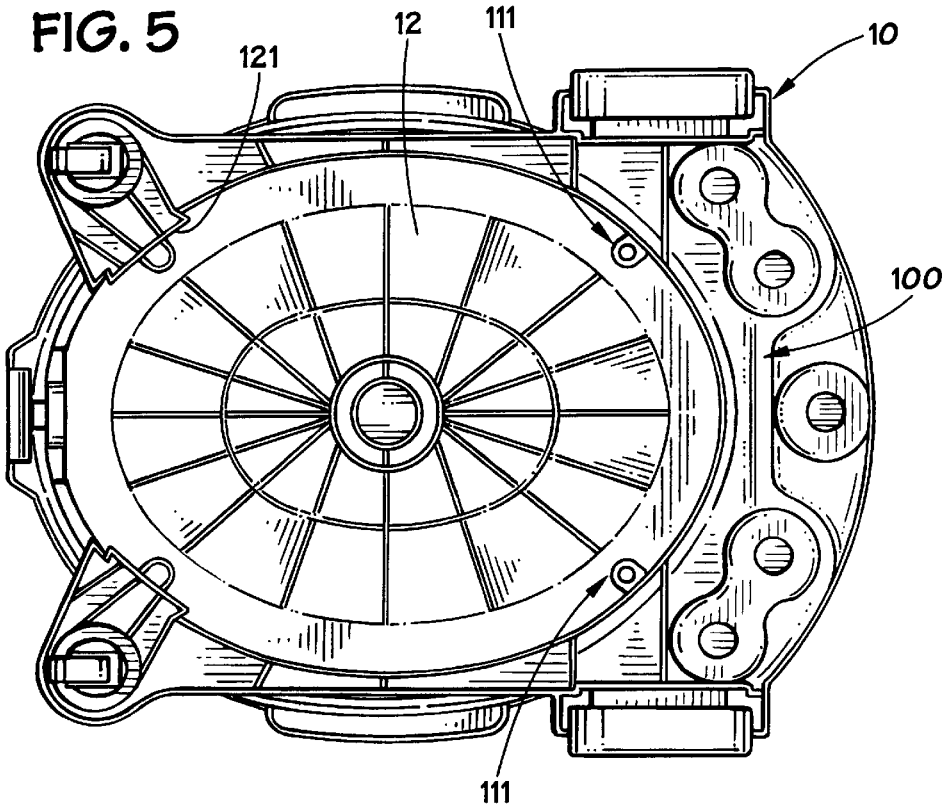

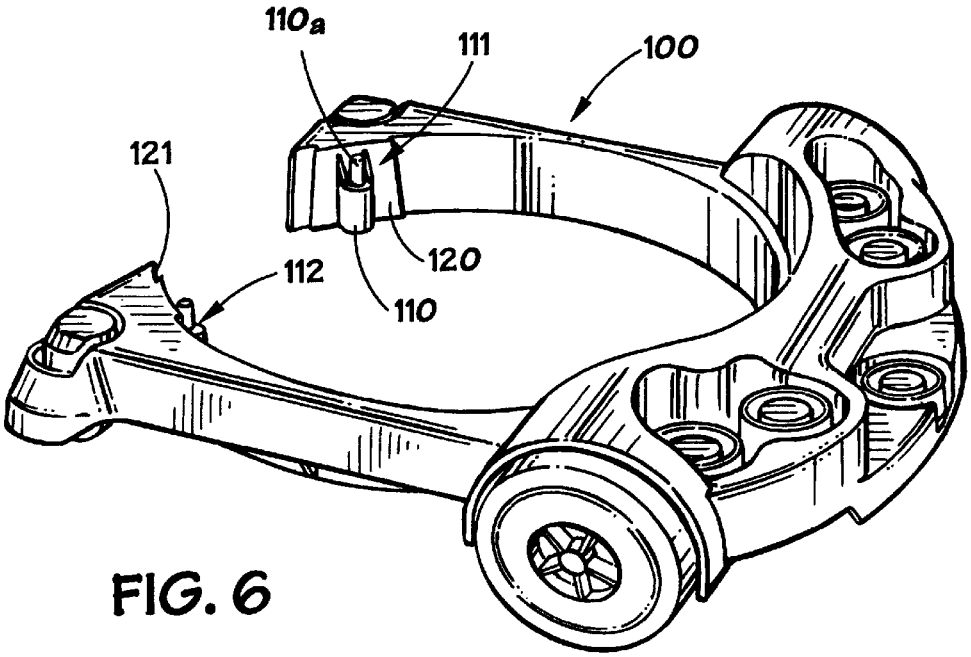
FIG. 6
FIG. 7
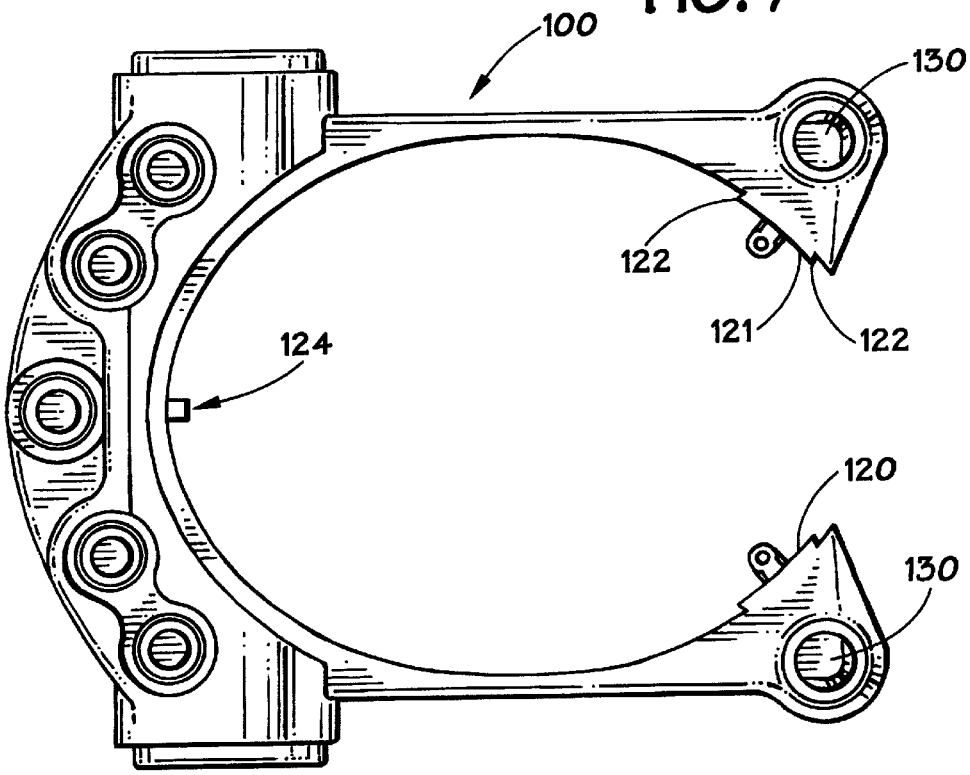

FIG. 14c
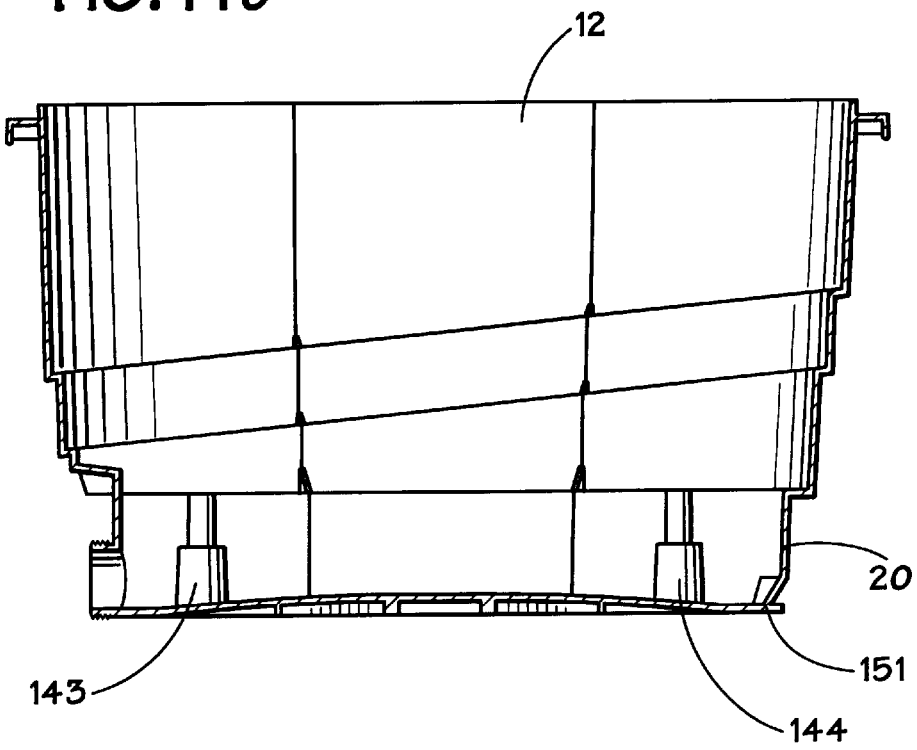
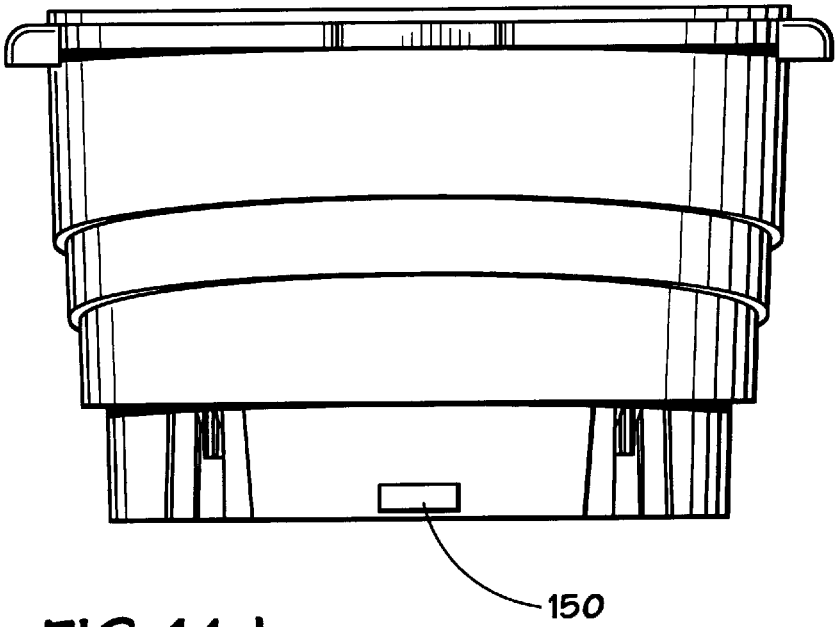
FIG. 14d

WET/DRY VACUUM DOLLY

CROSS-REFERENCE TO RELATED APPLICATIONS

This application claims the benefit of U.S. provisional application Ser. No. 60/098,578 filed on Aug. 31, 1998 by the same inventors, which is incorporated herein by reference in its entirety.

BACKGROUND OF THE INVENTION

1. Field of the Invention

The present invention relates generally to wet/dry vacuum cleaners, and more specifically, to a dolly for a wet/dry vacuum.

2. Description of Related Art

Vacuum appliances capable of picking up both wet and dry material, commonly referred to as wet/dry vacuums or wet/dry vacs, are often used in workshops and other environments where both wet and dry debris can accumulate. Wet/dry vacs conventionally consist of a collection canister or drum, and a powerhead within which a motor and impeller assembly is mounted. The motor and impeller assembly creates a suction within the drum, such that debris and/or liquid is drawn in to the drum through an air inlet to which a flexible hose can be attached. A filter within the drum prevents incoming debris from escaping from the drum while allowing filtered air to escape. Any liquid drawn into the drum is diffused and accumulates on the bottom of the drum. The drum typically includes a drain opening that is stopped by a plug or threaded cap, so that a user can remove the cap to drain accumulated liquid from the drum.

Conventional wet/dry vacs are usually mounted on a dolly having wheels or casters to allow easy movement of the vac during use. Known dollies for wet/dry vacs typically define an opening adapted to receive a bottom portion of the collection drum. When a user lifts the drum, however, the dolly is prone to falling off of the collection drum. Attempted solutions to this shortcoming include using fasteners, such as screws, to attach the dolly to the collection drum. However, insuring that the drum mates properly with the dolly for application of the fasteners requires tighter manufacturing tolerances, thus increasing design and manufacturing costs. Moreover, the need for using tools in applying the fasteners, and the added assembly steps of installing the fasteners further increases assembly time and costs.

The present invention addresses shortcomings associated with the prior art.

SUMMARY OF THE INVENTION

The invention relates to a dolly for a wet/dry vacuum, which in one embodiment includes a generally U-shaped member, which is adapted to have wheels mounted thereon.

In a first aspect of the invention, the dolly has at least two mounting members situated on either side of the open end of the U-shaped member. Each mounting member is adapted to mate with a corresponding mounting cavity defined by the collection drum.

In another aspect of the invention, the dolly includes a locking member adapted to snap into a locking cavity defined by the collection drum. The locking member is defined by the U-shaped member and situated generally at the closed end of the U-shaped member.

In a further aspect of the invention, the dolly includes at least two extending members. Each extending member is adapted to mate with a recess defined by the collection drum. The extending members are positioned generally at the open end of the U-shaped dolly.

In a yet another aspect of the invention, the mounting members are situated against the two extending members on either side of the open end of the U-shaped member.

In a still further aspect of the invention, the dolly may include two additional mounting members at the closed end of the U-shaped dolly.

BRIEF DESCRIPTION OF THE DRAWINGS

The features and advantages of the present invention will be best appreciated upon reference to the following detailed description and the accompanying drawings, in which:

FIG. 1 is a perspective view of a wet/dry vac employing a dolly in accordance with an embodiment of the present invention.

FIG. 4 illustrates a top view of the wet/dry vac illustrated in FIG. 1.

FIG. 5 illustrates a bottom view of the wet/dry vac illustrated in FIG. 1.

FIGS. 6–8 illustrate various views of the dolly for a wet/dry vac in accordance with the present invention.

FIG. 11 illustrates various views of the drum illustrated with the wet/dry vac of FIGS. 1 and 2.

FIG. 12(*c*) shows a close-up view of a mounting cavity located on the drum.

FIG. 15(*c*) shows a bottom view of the mounting cavity.

Figure 3:
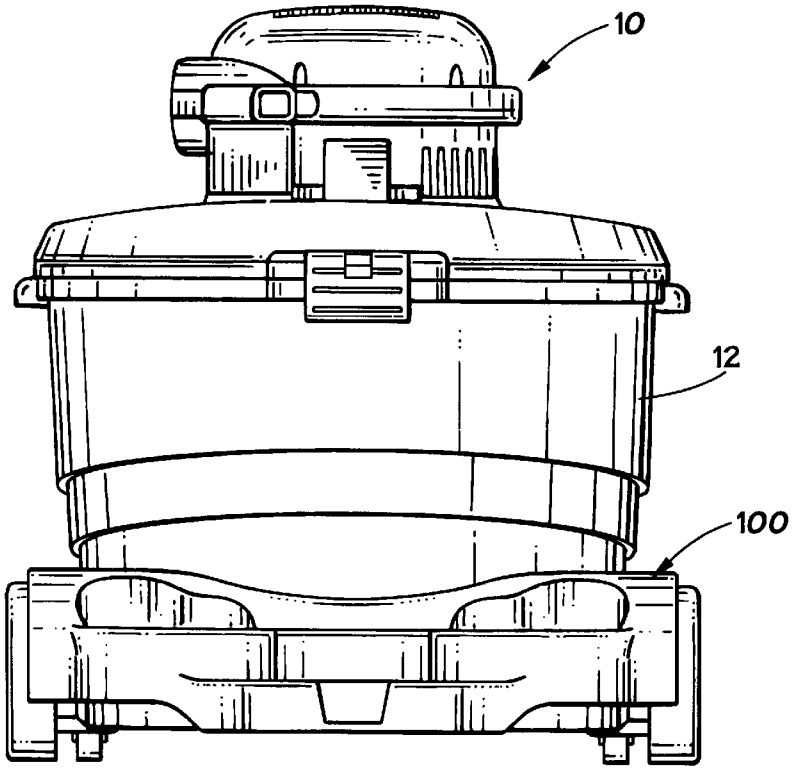
FIG. 3 illustrates a rear elevation view of the wet/dry vac illustrated in FIG. 1.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
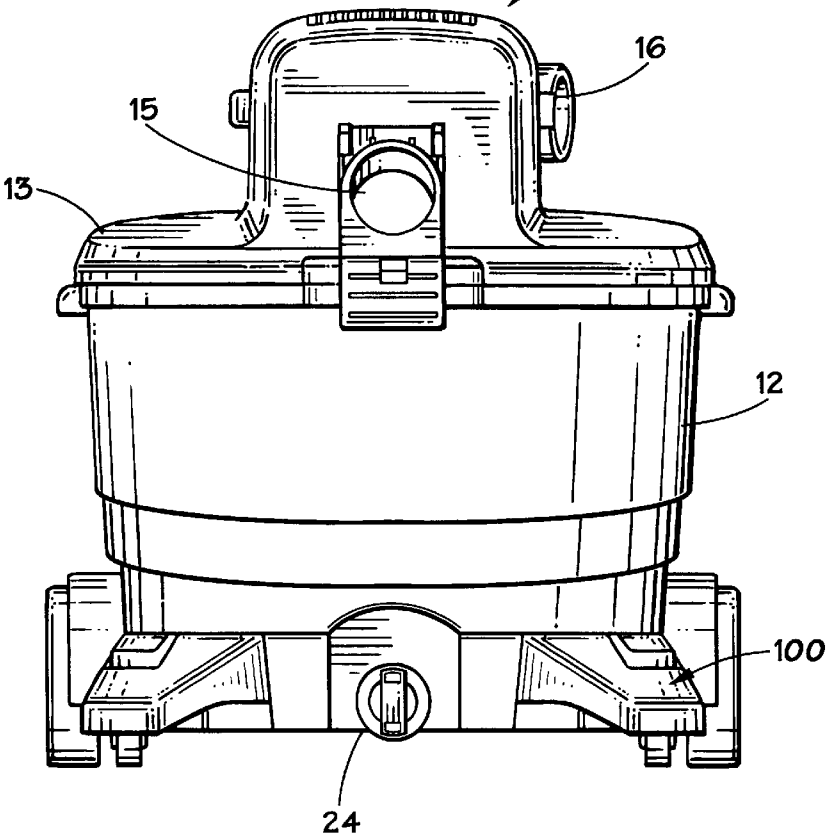
FIG. 2 is a front elevation view of the wet/dry vac illustrated in FIG. 1.
Figure 8:
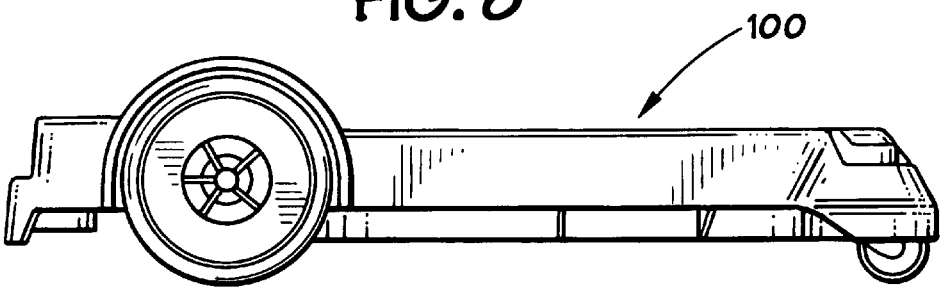
Figure 9:
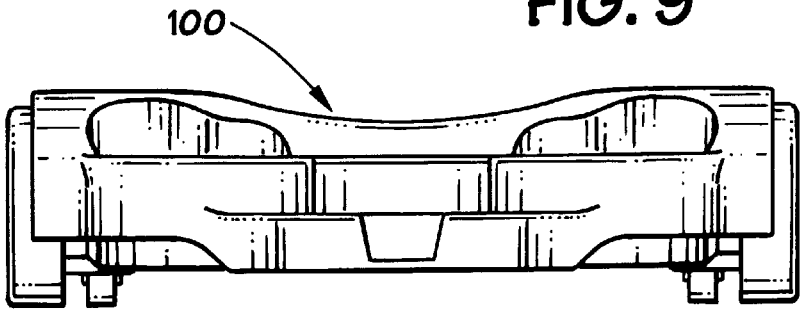
FIG. 9 illustrates a close-up view of the extending members forming angled shoulders with the inside surface of the dolly.

Turning to the figures, FIGS. 1 and 2 illustrate perspective and front elevation views of a wet/dry vac 10 employing a dolly 100 in accordance with an embodiment of the present invention. As shown in FIG. 1, the wet/dry vac 10 comprises a collection drum 12 having a lid 13 and a powerhead assembly 14. In the particular embodiment illustrated, the powerhead assembly 14 is detachable from the lid 13. The collection drum 12 illustrated is generally oval-shaped, and both the collection drum 12 and the lid 13 may be made of injection-molded plastic, such as polypropylene or the like, in accordance with conventional practice.

In accordance with conventional designs, an air inlet port 15 is defined in the lid 13 or, alternatively, may be defined in a side wall of the collection drum 12. The powerhead assembly 14 houses a motor and impeller assembly, and has defined therein an air exhaust or outlet port 16. The powerhead assembly 14 is operable to create a suction within the collection drum 12, such that debris and/or liquid is drawn in to the collection drum 12 through a hose (not shown) attached to the inlet port 15.

The dolly 100 is shown in greater detail in FIGS. 6–11. The dolly 100 is generally U-shaped. Each open end of the dolly 100 has a slot 130 for placing vacuum accessory. In one embodiment, the dolly 100 is designed such that the open end of the U-shaped dolly 100 is approximately 37–42% of the width of the dolly 100. That is, with such dimensions, the U-shaped dolly 100 bears the resemblance of a horse shoe.

The dolly 100 also includes two extending members 120, 121 and two mounting posts 111, 112 positioned adjacent the open portion of the U-shaped dolly 100 on either side of the open portion. The mounting posts 111, 112 are respectively situated against the extending members 120, 121. In one embodiment in accordance with the present invention, the mounting posts 111, 112 are placed approximately 45° from the virtual centerline of the dolly 100 on either side of the open portion. The virtual centerline is perpendicular with the middle of the closed end of the U-shaped dolly 100.

Figure 12:
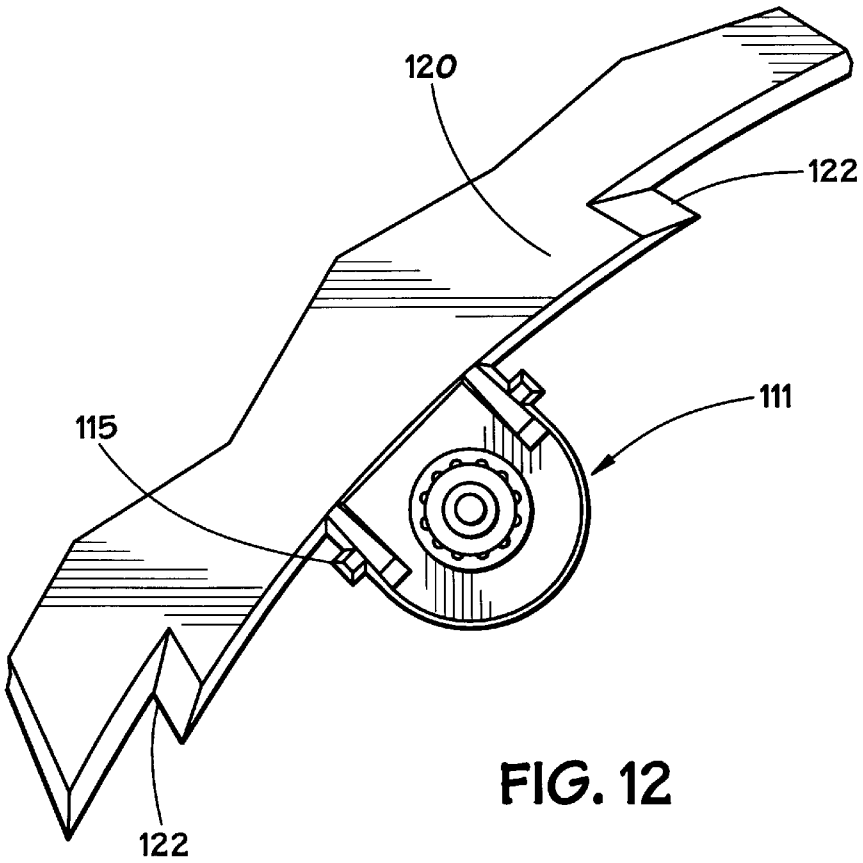
FIGS. 12(*a*) and (*b*) illustrate cross sectional side views of the locking cavity on the drum adapted to be mounted on the dolly.
Figure 13:
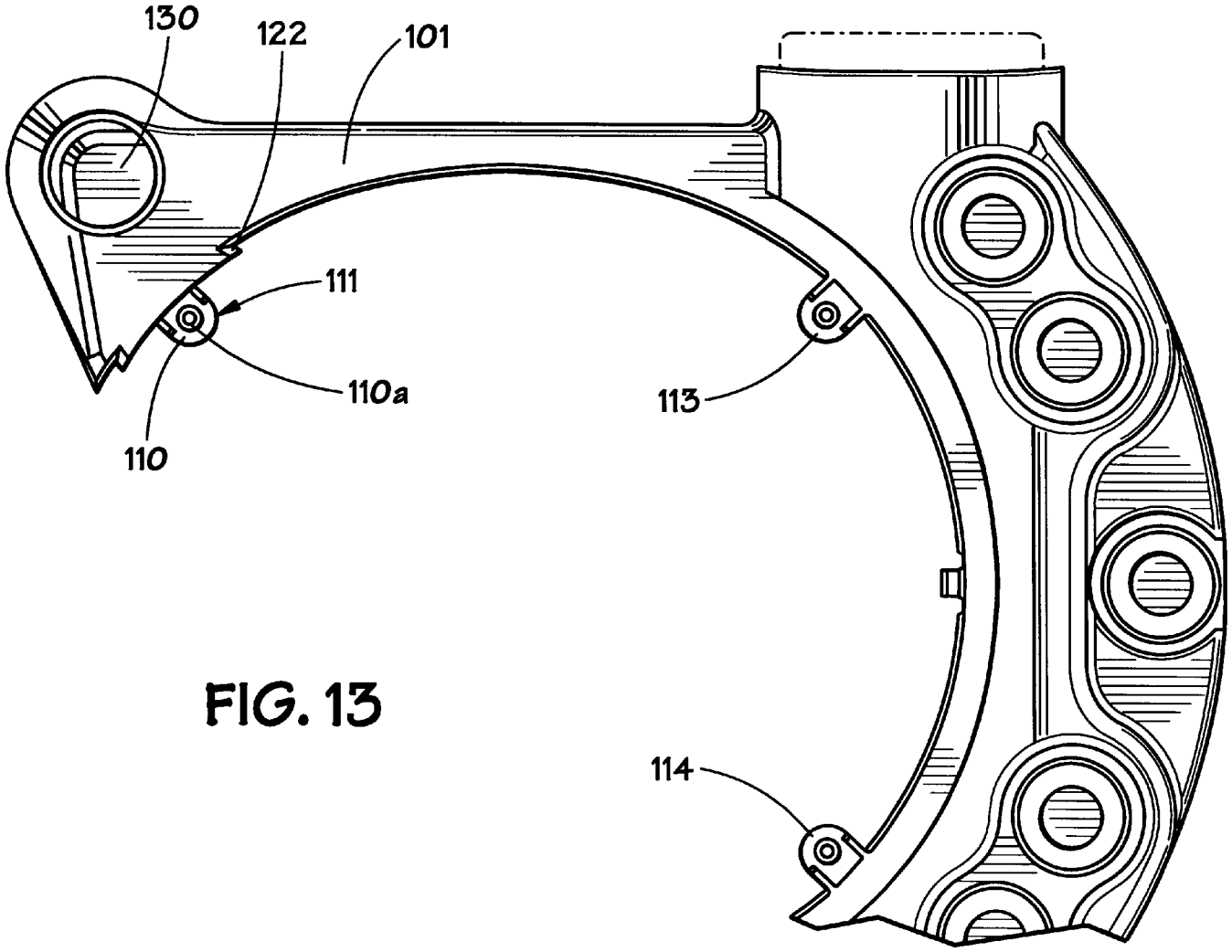
FIG. 13 illustrates a side profile view of the locking member that is defined by the dolly.

In another embodiment, each one of the mounting posts 111, 112 has a base 110 that is approximately cylindrical in shape and a cylindrical post 110*a* protruding from the center of the base 110, as shown in FIG. 6 and FIG. 13. In a further embodiment, the cylindrical post 110*a* has a radius of 0.211 inch whereas the base 110 has a radius of 0.528 inch. Each mounting post 111, 112 may have a height of 2.676 inches from the bottom of the base 110 to the top of the post 111, 112 and each cylindrical post may have a height of approximately 1 inch. A tab 115 is defined vertically along both sides of the base 110. (See FIGS. 12(*a*)–(*c*)) These tabs 115 are designed to lock with the tabs 145 defined at the bottom of the drum 12, which will be discussed below.

Furthermore, both extending members 120, 121 form angled shoulders 122 with the inside surface of the dolly 100 on either side of the extending members 120, 121. In one embodiment of the present invention, each shoulder 122 forms a 15° angle with a line that goes through the center of the mounting posts 111, 112 and perpendicular to the middle of the extending members 120, 121.

Figure 10:
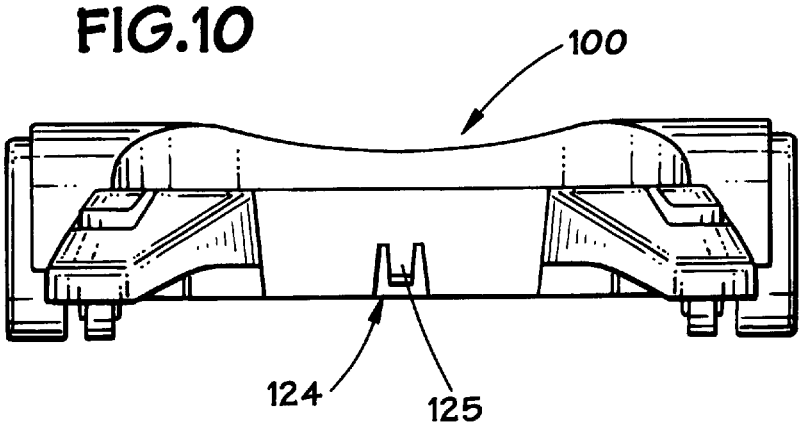
FIG. 10 illustrates a dolly in accordance with an alternative embodiment of the invention.
Figure 16:
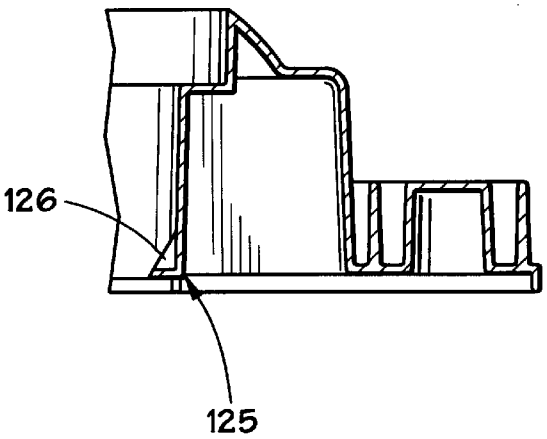
FIG. 16 shows a cross-sectional view of the locking member.

FIG. 10 illustrates a locking member 124 located at the closed end of the U-shaped dolly. In one embodiment, the locking member 124 is formed out of the dolly 100 at the center of its closed end. The locking member 124 may consist of a tab portion 125 with a gap on each side of the tab portion 125 such that the tab portion 125 could be easily bent, as illustrated in FIG. 10. As shown in FIG. 16, the tab portion 125 may consist of a vertical portion and a horizontal portion perpendicularly extending out of the vertical portion. Additionally, the tab portion 125 may consist of a nose bridge 126 that is triangular in shape that extends from the vertical portion to the horizontal portion. The nose bridge 126 further locks the dolly 100 with the drum 12 when mounted. The locking member 124 may also be made of a durable but flexible material, e.g., hard plastic.

In a further embodiment, FIG. 13 illustrates a dolly 101 in accordance with an alternative embodiment of the invention that further includes two mounting posts 113, 114. These additional mounting posts 113, 114 are positioned generally at the closed end of the U-shaped dolly 101. In one embodiment, they 113, 114 are positioned approximately 45° from the virtual center line of the dolly 100 at both sides of the closed end of the dolly 101. The virtual center line is perpendicular with the middle of the closed end of the U-shaped dolly 101.

Figure 14A:
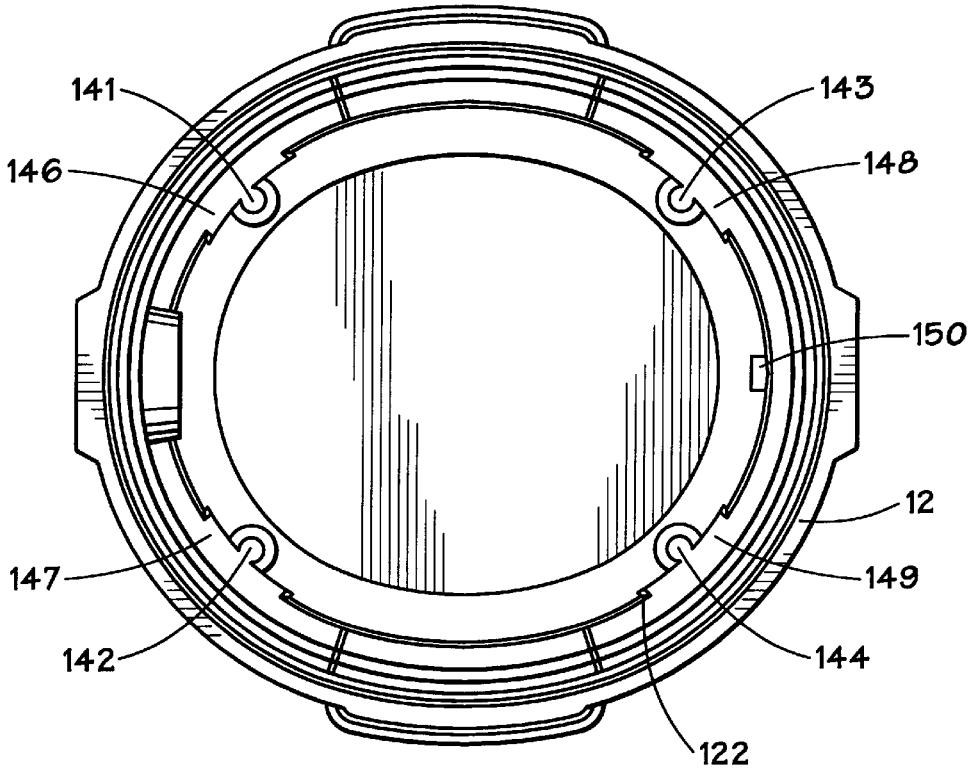
FIGS. 14(*a*)–(*d*) show several views of the drum of the wet/dry vac.
Figure 14B:
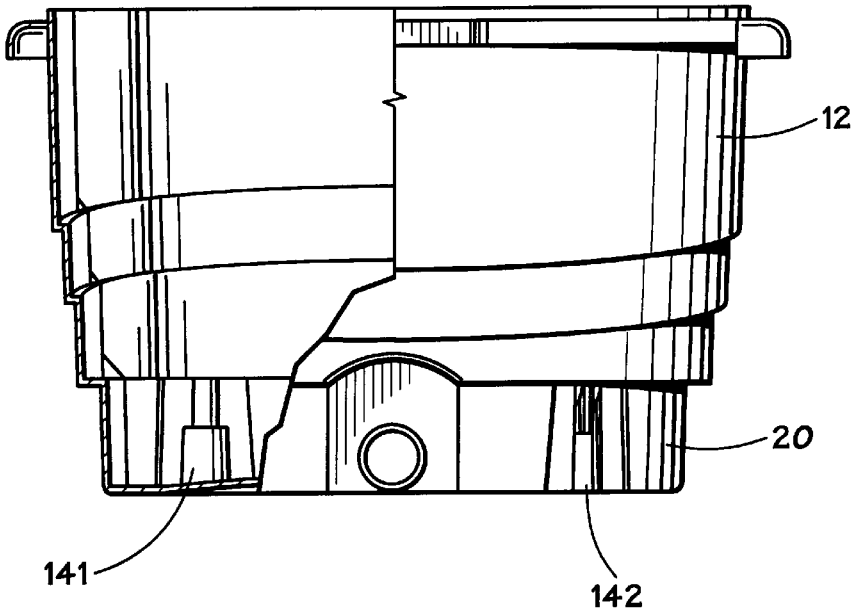
Figure 15C:
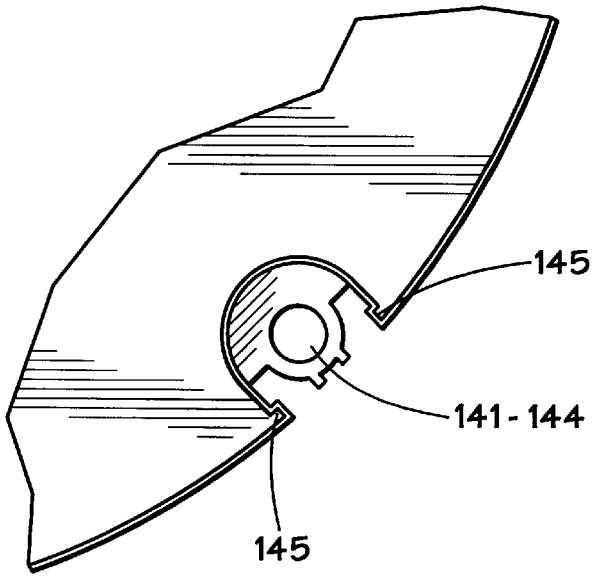
FIGS. 15(*a*)–(*b*) show cross-sectional side views of the mounting cavity.
Figure 15B:
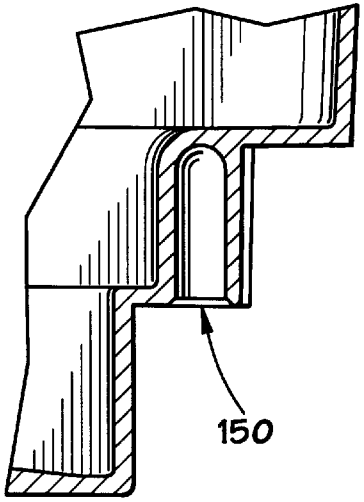
Figure 15A:
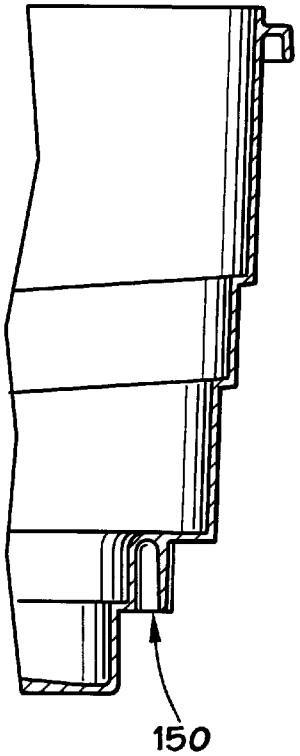
Figure 15D:
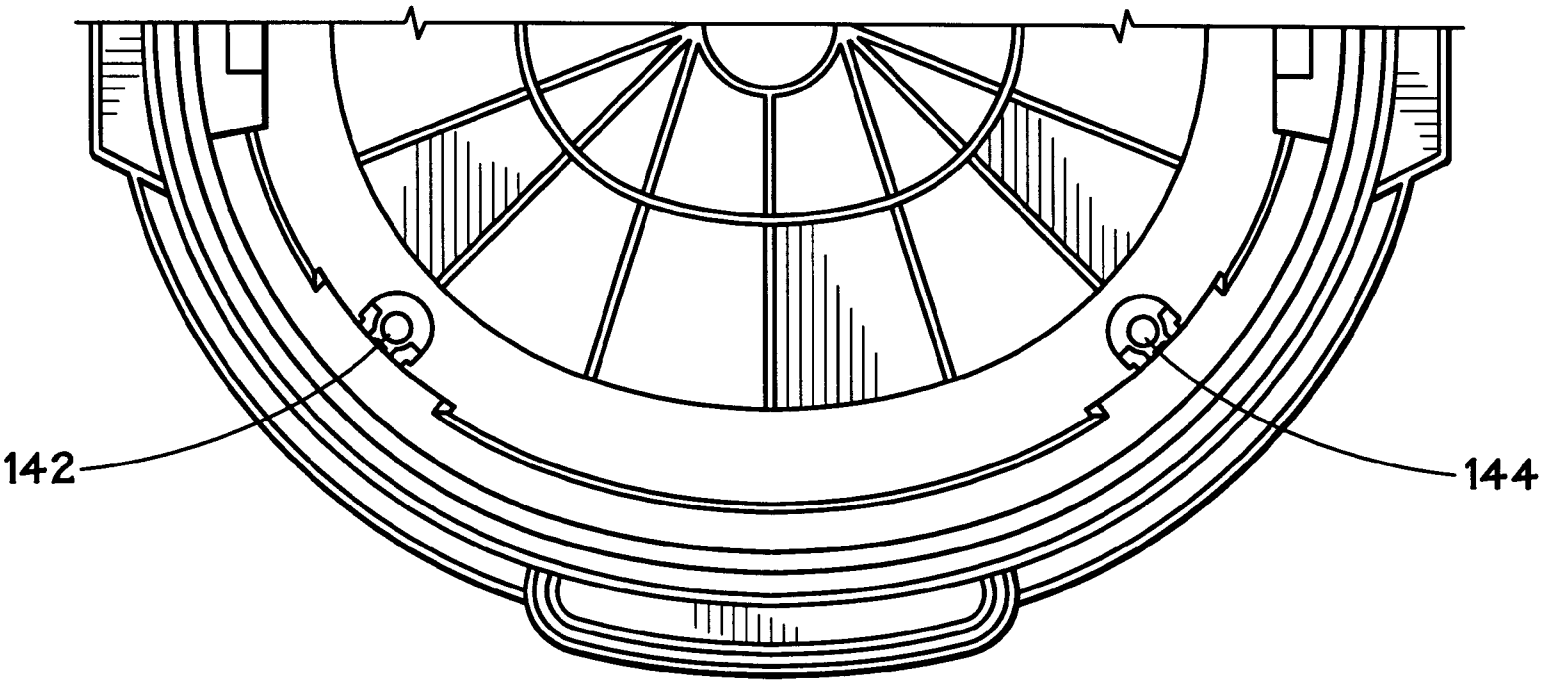

FIG. 14 illustrates several views of the drum 12. The collection drum 12 includes a lower portion 20 that is adapted to be mounted to the dolly 100 or 101. In one embodiment, the drum 12 is non-cylindrical, e.g., oval in shape. Additionally, the drum 12 may have a tapered width with the broadest width at the top and the narrowest width at the bottom. For instance, the longest width of the top portion of the drum may be 21.45 inches while longest width of the bottom portion may be 18 inches. The drum 12 may also have a height of 13.122 inches. Each layer of circumference tends to increase the rigidity of the side walls of drum 12, in the same way that similar bends, folds or corrugations in sheet metal products (e.g., automobile body parts) tend to increase those products' rigidity. This enhances the structural integrity of drum 12.

In one embodiment, the drum 12 further defines four mounting cavities 141, 142, 143, 144 adapted to receive the mounting posts 111, 112, 113, 114. The dolly 100, for instance, defines only two of the mounting posts 111, 112. In such an embodiment, two of the mounting cavities, such as mounting cavities 143, 144, may be eliminated. In is another embodiment, the dolly 101, as illustrated in FIG. 13, defines all four of the mounting posts 111–114. In such an embodiment, all four of the mounting cavities 141, 142, 143, 144 are utilized to receive the mounting posts 111–114. Accordingly, the mounting cavities 141–144 are defined on the drum at the same locations as the mounting posts 111–114 on the dolly 101 so that the mounting cavities 141–144 and the mounting posts 111–114 would mate easily. A cross sectional side view of a mounting cavity, as shown in FIGS. 15(*a*) or (*b*), shows the mounting cavity as U-shaped. This U-shaped cavity can easily accommodate the top portion of a cylindrical post 110*a*. In one embodiment, each mounting cavity has a gap width of 0.443 inch, sufficient to receive the cylindrical post 110*a*.

FIG. 15(*c*) shows a close-up of the bottom view of a mounting cavity. Each cavity is U-shaped with a tab 145 defined on either side of the open end at the inside portion of the open ends. The tabs 145 are designed to lock with the tabs 115 defined on the dolly 100 to further assist the drum 12 in holding each mounting post inside the cavity. The tabs are locked together when the drum 12 is mounted on the dolly 100, 101.

Additionally, the drum 12 defines at least two recesses 146, 147 adapted to mate with the extending members 120, 121. Two additional recesses 148, 149 may be added to provide an alternative orientation for the collection drum 12.

These recesses 146–149 are adapted to mate with the extending members 120, 121. Consequently, the recesses also form cavities to mate with the angled shoulders 122.

One end of the drum 12 defines a drain opening 24, and the opposite end of the dun 12 defines a locking cavity 150 into which the locking member 124 snaps to lock the drum 12 and dolly 100, 101 together. FIG. 14(*c*) illustrates a side profile view of the locking cavity 150 at the bottom of the drum 12. The locking cavity 150 defines a lip 151 that is on the same plane as the bottom floor of the drum 12. The lip 151 is adapted to mate with the tab portion 125 of the locking member 124, which further assists the dolly 100, 101 to hold the drum 12 inside the dolly 100, 101. As shown in FIG. 14(*c*), the locking cavity 150 is carved out of the bottom portion of the drum 12 at a 60° angle from the top of the lip 151.

Similarly, the dolly 101, as illustrated in FIG. 13, uses the additional mounting posts 113, 114 with corresponding mounting cavities 143, 144 to further fix the drum 12 to the dolly 101.

Thus, in addition to the combination of the locking member 124 and the locking cavity 150, the combination of the mounting posts 111–114 and the mounting cavities 141–144 and the combination of the extending members 120, 121 and the recesses 146–147 form interference fits to insure that the dolly 100, 101 securely attaches to the drum 12.

Since one end of the dolly 100, 101 is open, the manufacturing tolerances associated with the mounting posts 111–114 and mounting cavities 141–144 may be relaxed. In other words, since the dolly 100, 101 does not form a closed, rigid structure, the open end of the U-shaped dolly 100, 101 may be varied to fit a drum 12 having wide molding variations.

With either embodiment of the dolly 100, 101 disclosed herein, no tools are required in mounting the drum 12 to the dolly 100, 101. The dolly 100, 101 is simply stacked over the drum 12 and tapped into place. Eliminating the need for tools in the assembly process simplifies manufacturing and reduces production costs. To remove the dolly 100, 101, the locking member 124 must be pried back against its spring force, then the interference fit between the mounting posts 111–114 and mounting cavities 141–144 must be defeated, for instance, by pulling or tapping the two parts until they separate.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

What is claimed is:

1. A dolly for a wet/dry vacuum which includes a collection drum, the dolly comprising:

a generally U-shaped member adapted to have wheels mounted thereon, the U-shaped member having open and closed ends;

at least two mounting members situated on either side of the open end of the U-shaped member, each mounting member adapted to mate with a corresponding mounting cavity defined by the collection drum; and a locking member; wherein the collection drum defines an opening, the opening adapted to lock with the locking member.

2. The dolly as recited in claim 1, wherein the locking member is defined by the U-shaped member and situated generally at the closed end of the U-shaped member.

3. The dolly as recited in claim 1, wherein the opening is positioned generally at the closed end of the U-shaped member.

4. A dolly for a wet/dry vacuum which includes a collection drum, the dolly comprising:

a generally U-shaped member having an inside surface and open and closed ends;

at least two mounting members situated on either side of the open end of the U-shaped member, each mounting member adapted to mate with a corresponding mounting cavity defined by the collection drum; and at least two extending members, each extending member protruding beyond the inside surface of the U-shaped member and adapted to mate with a recess defined by the collection drum.

5. The dolly as recited in claim 4, wherein the at least two extending members are situated on either side of the open end of the U-shaped member and define angled shoulders with the inside surface of the open end of the U-shaped member on either side of the extending members.

6. The dolly as recited in claim 4, wherein a first of the at least two mounting members is situated against a first of the at least two extending members, and a second of the at least two mounting members is situated against a second of the at least two extending members.

7. The dolly as recited in claim 6, wherein the at least two mounting members protrude from the at least two extending members.

8. A dolly for a wet/dry vacuum which includes a collection drum, the dolly comprising:

a generally U-shaped member adapted to have wheels mounted thereon;

a locking member defined by the U-shaped member; said locking member comprising a bendable tab portion snap-lockable with a mating recess in the collection drum.

9. The dolly as recited in claim 8, further comprising at least two extending members, each extending member adapted to mate with a recess defined by the collection drum.

10. The dolly as recited in claim 9, wherein the at least two extending members are situated on either side of the open end of the U-shaped member and define angled shoulders with the inside surface of the open end of the U-shaped member on either side of the extending members.

11. The dolly as recited in claim 9, wherein a first of the at least two mounting members is situated against a first of the at least two extending members, and a second of the at least two mounting members is situated against a second of the at least two extending members.

12. A dolly for a wet/dry vacuum which includes a collection drum, the dolly comprising:

a generally U-shaped member adapted to have wheels mounted thereon;

a locking member defined by the U-shaped member;

wherein the collection drum defines an opening receptive of the locking member by a snap-fit; and wherein the locking member is situated generally at the closed end of the U-shaped member.

13. The dolly as recited in claim 12, wherein the opening is positioned generally at the closed end of the U-shaped member.

14. A dolly for a wet/dry vacuum which includes a collection drum, the dolly comprising:

a generally U-shaped member adapted to have wheels mounted thereon;

a locking member defined by the U-shaped member;

wherein the collection drum defines an opening receptive of the locking member by a snap-fit; and at least two mounting members situated on either side of the open end of the U-shaped member, each mounting member adapted to mate with a corresponding mounting cavity defined by the collection drum.

15. A dolly for a wet/dry vacuum which includes a collection drum, the dolly comprising:

a generally U-shaped member having an inside surface, open and closed ends, and wheels mounted thereon; and at least two extending members situated on either side of the open end of the U-shaped member, each extending member protruding beyond the inside surface of the U-shaped member and adapted to mate with a recess defined by the collection drum.

16. The dolly as recited in claim 15, wherein the at least two extending members define angled shoulders with the inside surface of the open end of the U-shaped member on either side of the extending members.

17. The dolly as recited in claim 15, further comprising at least two mounting members situated on either side of the open end of the U-shaped member, each mounting member adapted to mate with a corresponding mounting cavity defined by the collection drum.

18. The dolly as recited in claim 17, wherein a first of the at least two mounting members protrudes from a first of the at least two extending members, and a second of the at least two mounting members protrudes from a second of the at least two extending members.

19. The dolly as recited in claim 15, further comprising:

a locking member;

wherein the collection drum defines an opening; and wherein the locking member is adapted to snap into the opening.

20. The dolly as recited in claim 19, wherein the locking member is defined by the U-shaped member and situated generally at the closed end of the U-shaped member.

21. The dolly as recited in claim 19, wherein the opening is positioned generally at the closed end of the U-shaped member.

22. A wet/dry vac, comprising:

a generally U-shaped dolly having wheels mounted thereon and open and closed ends;

a collection drum defining an opening, the collection drum removably mounted on the dolly;

a lid coupled to the collection drum;

a powerhead assembly coupled to the lid;

an inlet port disposed in one of the lid or the collection drum; and wherein the U-shaped dolly includes a locking member, the locking member adapted to lock with the opening defined by the collection drum.

23. The wet/dry vac as recited in claim 22, wherein the U-shaped dolly includes at least two mounting members situated on either side of the open end of the U-shaped dolly, each mounting member adapted to mate with a corresponding mounting cavity defined by the collection drum.

24. The wet/dry vac as recited in claim 22, wherein the U-shaped dolly comprises at least two extending members, each extending member adapted to mate with a recess defined by the collection drum.

25. The dolly as recited in claim 22, wherein the locking member comprises a flexible tab snap-fittable into the opening defined by the collection drum.

26. The wet/dry vac as recited in claim 22, wherein the U-shaped dolly includes a locking member situated at the closed end of the U-shaped dolly; and wherein the collection drum defines an opening adapted to lock with the locking member.

27. A dolly for a wet/dry vacuum which includes collection drum, the dolly comprising:

a generally U-shaped member, the U-shaped member open and closed ends;

two mounting member situated on either side of the open end of the U-shaped member, each mounting member comprising a base with a cylindrical post protruding therefrom;

wherein the collecting drum defines two cavities receptive of the two cylindrical posts and;

wherein the two mounting members each further comprise a base member tab, and each collection drum cavity further comprises a cavity tab, the base member tabs and cavity tabs being lockingly engagable with one another.

28. A dolly for wet/dry vacuum which includes a collection drum, the dolly comprising:

a generally U-shaped member, the U-shaped member having open and closed ends;

two mounting members situated on either side of the open end of the U-shaped member, each mounting member comprising a base with a cylindrical post protruding therefrom;

wherein the collection drum defines two cavities receptive of the two cylindrical posts and;

wherein the U-shaped member further comprises a locking member, the locking member comprising a bendable tab; and wherein the collection drum further comprises a recess engagable with the bendable tab.

29. The dolly as recited in claim 28, wherein the bendable tab further comprises a vertical portion, a horizontal portion, and a nose bridge extending between the horizontal and vertical portions, wherein the nose bridge locks with the collection drum.

30. The dolly as recited in claim 28, wherein the recess further comprises a lip adapted to mate in a snap-fit with the bendable tab.

31. A dolly for a wet/dry vacuum which includes a collection drum, the dolly comprising:

a generally U-shaped member, the U-shaped member having open and closed ends;

two mounting members situated on either side of the open end of the U-shaped member;

two mounting members situated on either side of the closed end of the U-shaped member;

wherein the collection drum defines four cavities receptive of the four mounting members.

32. The dolly as recited in claim 31, wherein each of the four mounting members comprises a base with a cylindrical post protruding therefrom.

33. The dolly as recited in claim 31 wherein the U-shaped member further includes an inside surface and the four mounting members protrude beyond the inside surface in a radially interior manner.

34. A dolly for a wet/dry vacuum which includes a collection drum, the dolly comprising:

a generally U-shaped member having an inside surface, open and closed ends, and wheels mounted thereon; and at least two mounting members situated on either side of the open end of the U-shaped member, each mounting member protruding beyond the inside surface of the U-shaped member and adapted to mate with a recess defined by the collection drum.

* * * * *